US005688626A

United States Patent [19]

Patel et al.

[11] Patent Number: 5,688,626

[45] Date of Patent: Nov. 18, 1997

[54] GAMUT TONER AGGREGATION PROCESSES

[75] Inventors: Raj D. Patel, Oakville; Grazyna E. Kmiecik-Lawrynowicz, Burlington; Richard P. N. Veregin, Mississauga; Maria N. V. McDougall, Burlington, all of Canada

[73] Assignee: Xerox Corporation, Stamford, Conn.

[21] Appl. No.: 628,062

[22] Filed: Apr. 8, 1996

[51] Int. Cl.[6] ..... G03G 9/09

[52] U.S. Cl. ..... 430/137; 430/45

[58] Field of Search ..... 430/137, 109, 430/45

[56] References Cited

U.S. PATENT DOCUMENTS

| | | | |
|---|---|---|---|
| 4,983,488 | 1/1991 | Tan et al. | 430/137 |
| 4,996,127 | 2/1991 | Hasegawa et al. | 430/109 |
| 5,290,654 | 3/1994 | Sacripante et al. | 430/137 |
| 5,346,797 | 9/1994 | Kmiecik-Lawrynowicz et al. | 430/137 |
| 5,370,963 | 12/1994 | Patel et al. | 430/137 |
| 5,525,452 | 6/1996 | Hopper et al. | 430/137 |

*Primary Examiner*—John Goodrow
*Attorney, Agent, or Firm*—E. O. Palazzo

[57] ABSTRACT

A process for the preparation of a combination of color toners comprised of a cyan toner, a magenta toner, a yellow toner, and a black toner, each of said toners being comprised of resin and pigment, and wherein the pigment is cyan, magenta, yellow and black, each of the said pigments are dispersed in a nonionic, or neutral charge surfactant, and wherein each toner in the combination is prepared by (i) preparing a pigment dispersion, which dispersion is comprised of a pigment and nonionic water soluble surfactant;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates; and (iv) heating said bound toner size aggregates above about the Tg of the resin.

38 Claims, No Drawings

GAMUT TONER AGGREGATION PROCESSES

BACKGROUND OF THE INVENTION

The present invention is generally directed to toner processes, and more specifically, to aggregation and coalescence processes for the preparation of toner compositions. In embodiments, the present invention is directed to the economical in situ chemical preparation of toners without the utilization of the known pulverization and/or classification methods, and wherein in embodiments a combination of a set of color toners, which have a wide color gamut and excellent projection efficiency, are provided and which toners possess in embodiments substantially similar, or the same triboelectrical charging characteristics without the aid of external additives. The toners prepared possess, for example, an average volume diameter of from about 1 to about 25, and preferably from 2 to about 10 microns, and a narrow GSD (geometric standard deviation) of, for example, from about 1.16 to about 1.26 as measured on the Coulter Counter. The resulting toners can be selected for known electrophotographic imaging processes, printing processes, including color processes, and lithography. In embodiments, the present invention enables toners with similar triboelectric charging values, and wherein toner surface additives can be avoided or minimized, and wherein the surfactant within which the toner pigment for each toner is dispersed in the same surfactant type, that is a nonionic surfactant, like those illustrated herein including a sulfonal preferred surfactant available from Air Products as Surfynol 104, Surfynol 104 family, and Surfynol GA, and other similar nonionic surfactants containing aliphatic hydroxy groups. The surfactant selected for the pigment dispersion in embodiments of the present invention is water soluble, and thus can be easily removed by washing with water, in contrast to, for example, prior art surfactants like polyvinyl alcohol which bind to the pigment and are not readily removable. Furthermore, the surfactant selected also enables a stable pigment dispersion in which the pigment particles are of a size of from about 60 to about 100 nanometers, thereby enabling the pigment to be easily dispersed in latex particles. Moreover, in embodiments of the present invention. The toners obtained comprised of resin and pigment, such as four toners each with different pigments, in each instance possess the same triboelectric charging characteristics even though different pigments are selected for each toner, and different concentrations of pigments may be present, and such characteristics are of importance with respect to the generation of full process color copies, such as the generation of developed colored images in the Xerox Corporation 5775.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.3 to about 1.7. In these processes, it is usually necessary to subject the aforementioned toners to a classification procedure such that the geometric size distribution of from about 1.3 to about 1.4 is attained. To obtain better geometric size distribution, the toners have to be further classified leading to low toner yields. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields can be obtained after classification, such as from about 50 percent to about 70 percent; particle sizes of 4 to 7 microns leads to even lower yields such as 40 to 55 percent. With the processes of the present invention in embodiments, small average particle sizes of, for example, from about 3 microns to about 9 microns, and preferably 5 microns, are attained without resorting to classification processes, and wherein narrow geometric size distributions are attained, such as from about 1.16 to about 1.30, and preferably from about 1.16 to about 1.25. High toner yields are also attained, such as from about 90 percent to about 96 percent, in embodiments of the present invention. In addition, by the toner particle preparation process of the present invention in embodiments, small particle size toners of from about 3 microns to about 7 microns can be economically prepared in high yields, such as from about 90 percent to about 96 percent by weight based on the weight of all the toner material ingredients, such as toner resin and pigment.

There are illustrated in U.S. Pat. Nos. 5,364,729 and 5,403,693 methods of preparing toner particles by blending together latexes with pigment particles. Also mentioned are U.S. Pat. Nos. 4,996,127; 4,797,339 and 4,983,488. The disclosures of each of these patents are totally incorporated herein by reference.

In copending patent application and patents U.S. Pat. No. 5,556,727, U.S. Pat. No. 5,591,552; U.S. Pat. No. 5,554,471; U.S. Pat. No. 5,607,804, U.S. Ser. No. 542,265, and U.S. Ser. No. 542,371, now U.S. Pat. No. 5,620,820 the disclosures of which are totally incorporated herein by reference, there is illustrated a combination of four color toners for the development of electrostatic latent images enabling the formation of a full color gamut image, and wherein the four toners are comprised of a cyan toner, a magenta toner, a yellow toner, and a black toner, each of said toners being comprised of resin and pigment, and wherein the pigment for the cyan toner is a β-copper phthalocyanine, the pigment for the magenta toner is a xanthene silicomolybdic acid salt of RHODAMINE 6G basic dye, the pigment for the yellow toner is a diazo benzidine, and the pigment for the black toner is carbon black. The pigments of the aforementioned copending patent applications can be selected for the toners of the present invention in embodiments thereof.

Emulsion/aggregation processes for the preparation of toners are illustrated in a number of Xerox Corporation patents, the disclosures of which are totally incorporated herein by reference, such as U.S. Pat. Nos. 5,290,654, 5,278,020, 5,308,734, 5,346,797, 5,370,963, 5,344,738, 5,403,693, 5,418,108, 5,364,729, and 5,346,797.

SUMMARY OF THE INVENTION

It is an object of the present invention to provide toner processes with many of the advantages illustrated herein.

In another object of the present invention there are provided simple and economical processes for the direct preparation of a set of black and colored toner compositions with, for example, excellent pigment dispersion stable triboelectric charging values, and narrow GSD.

In another object of the present invention there are provided a set of black and colored toner compositions which are prepared from aqueous predispersed pigments comprised of finely grounded pigment particles stabilized by nonionic surfactants, such as Surfynol 104 GA, and in embodiments other nonionic surfactants containing aliphatic hydroxy groups. Pigments stabilized by the preferred Surfynol surfactants also exhibit extended dispersion stability or shelf life. These dispersions when utilized in the aggregation/coalescence processes as illustrated herein, such as illustrated in U.S. Pat. No. 5,403,693, are subjected to washing with water, whereby the surfactant is easily and substantially fully removed, resulting in final toner products with similar triboelectrical properties regardless of the pigment color.

It is another object of the present invention to provide a process for obtaining a full set of xerographic color toners having properties, such as (a) wide color gamut, (b) acceptable projection efficiency (over 80 percent and from about 85 to about 95 percent in embodiments), and (c) stable excellent triboelectrical properties. Wide toner color gamuts are readily obtainable with the processes of the present invention regardless of the form of the pigment used, for example dry, wet cake or water dispersions based. With the toners obtained in accordance with the present invention there is enabled the combination of wide, or numerous, color gamuts, excellent projection efficiencies, and desired triboelectric toner charges, or values. Projection efficiency is essentially a measure of the amount of light transmitted and a measure of the true shade of the color that is transmitted. The higher the number the better is the projection efficiency. Therefore, the pigment size can be a very important factor in projection efficiency in that the larger the pigment particle size, the less desirable is the light scattering when the pigment is fused and projected on a transparency. Since emulsion aggregation involves aggregation of both, submicron latex and pigment particles into toner size particles, where the growth in particle size is, for example, from submicron to about 3 to about 10 microns there could be a tendency toward a reduction in the projection efficiency, that is, for example, the pigment dispersion does not improve during the process. In conventional non-in situ toner processes, the pigment is further attrited in the melt mixing process and hence the projection efficiency improves. Thus, it can be of importance to utilize in emulsion aggregation coalescence in situ process pigments of a small size as indicated herein, and wherein, for example, the projection efficiency, therefore, is primarily a function of pigment particle size, and is dependent on the type of surfactant used to disperse the pigment, providing pigment stability is exhibited.

It is another object of the present invention to provide a process using dispersed pigments for obtaining in combination a wide color gamut, excellent projection efficiency, and toner particles having similar charging behavior despite the complex pigment chemistry. For example, since the pigment chemistry of Red 81.3, Yellow 17, Blue 15.3 and REGAL 330® carbon black are all very dissimilar, the surfactants or the grinding aids selected are custom tailored for each pigment to provide superior pigment stability. Often, reference the prior art, the surfactant, such as polyvinyl alcohol, or the pigment grinding aids are grafted on to the pigment and cannot easily be removed by washing with water, thus the pigment particles evidence very little to no charging. In contrast, with the present invention, wherein nonionic surfactants, such as Surfynols, which are completely water miscible, and the like are selected, these surfactants are readily removable when washed with water, and there results toners with similar triboelectrical characteristics.

In another object of the present invention there are provided simple and economical in situ processes for the preparation of a combination of a set of color toners with a wide color gamut, an excellent projection efficiency and similar charging behavior, and wherein each toner is prepared by an aggregation/coalescence process comprised of (i) utilization of pigment dispersion comprised of pigment, dispersed or ground in a water soluble nonionic surfactant comprised of the Surfynols; (ii) preparing a pigment mixture of (i) in water, cationic surfactant and other known optional additives by shearing, microfluidizing or ultrasonifying; (iii) shearing the pigment mixture of (ii) with a latex mixture comprised of a polymer resin, anionic surfactant and nonionic surfactant thereby causing a flocculation of the latex particles with pigment particles, which on further stirring allows for the formation of electrostatically stable aggregates of from about 0.5 to about 10 microns in volume diameter as measured by the Coulter Counter; (iv) adding additional, for example 1 to 10 weight percent of anionic or nonionic surfactant, to the formed aggregates to, for example, increase their stability and to retain the particle size and particle size distribution during further heating; and (v) coalescing or fusing the aforementioned aggregated particle mixture by heat to toner composites, or a toner composition comprised of resin and pigment.

Combination, gamut, or set refers, in embodiments of the present invention, to separate toners that are not mixed together, rather each toner exists as a separate composition and each toner is incorporated into separate housings containing carrier in a xerographic machine, such as the Xerox Corporation 5775. For example, the cyan toner is present in one developer housing, the magenta toner is present in a second separate developer housing, the yellow toner is present in a third separate developer housing, and the black toner is present in a fourth separate developer housing; and wherein each developer housing includes therein carrier particles such as those particles comprised of a core with a coating thereover. These toner combinations are prepared as illustrated herein by emulsion/aggregation/coalesence methods, and wherein the pigment for each toner is dispersed in a nonionic surfactant or grinding aids, such as the Surfynols, thereby permitting the surfactant to be easily removed by washing with water and resulting in toners with similar charging behavior independent of the pigment type selected. The similar toner charging behavior is observed upon removal of the surfactants selected for the processes of the present invention, including in embodiments the surfactants selected for the preparation of the latex, the pigment surfactants or grinding aids, and the surfactant used to stabilize the aggregates.

In a further object of the present invention there is provided a process for the preparation of a combination of toner compositions with an average particle volume diameter of from between about I to about 20 microns, and preferably from about 1 to about 7 microns, and with a narrow GSD of from about 1.2 to about 1.3 and preferably from about 1.16 to about 1.25 as measured by a Coulter Counter.

In a further object of the present invention there is provided a process for the preparation of a combination of four toner compositions with certain effective particle sizes by controlling the temperature of the aggregation which comprises stirring and heating about below the resin glass transition temperature (Tg).

In a further object of the present invention there is provided a process for the preparation of a combination of four toners with particle size distribution which can be improved from 1.4 to about 1.16 as measured by the Coulter Counter by increasing the temperature of aggregation from about 25° C. to about 45° C.

Moreover, in a further object of the present invention there is provided a process for the preparation of a combination of four toner compositions which after fixing to paper substrates results in images with a gloss of from 20 GGU (Gardner Gloss Units) up to 70 GGU as measured by Gardner Gloss meter matching of toner and paper.

In another object of the present invention there is provided a combination of four toner each toner being comprised of a composite toner of polymeric resin with pigment and optional additives in high yields of from about 85 percent to about 98 percent by weight of toner without resorting to classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

Another object of the present invention resides in processes for the preparation of small sized toner particles with narrow GSDs, and excellent pigment dispersion by the aggregation of latex particles with pigment particles dispersed in water and a surfactant, and wherein the aggregated particles of toner size can then be caused to coalesce by, for example, heating. In embodiments, some factors of interest with respect to controlling particle size and particle size distribution include the concentration of the surfactant used for the pigment dispersion, the concentration of the resin component like acrylic acid in the latex, the temperature of coalescence, and the time of coalescence.

Further, in another object of the present invention there are provided toners enabling an entire range, or an entire series of colors, such as reds, blues, greens, browns, yellows, pinks, violets, mixtures thereof of colors, and the like, and variations thereof like from light red to dark red and the reds therebetween, from light green to dark green and the greens therebetween, from light brown to dark brown and the browns therebetween, from light yellow to dark yellow and the yellows therebetween, from light violet to dark violet and the violets therebetween, from light pink to dark pink and the pinks therebetween, and the like.

Moreover, in another object of the invention there are provided toners with excellent high intensity color resolutions, and which toners possess high light transmission allowing about 70 to about 98 percent of the transmitted light passing through a fused image on a transparency to reach the screen from an overhead projector.

It is another object of the present invention to provide an in situ process such as emulsion aggregation coalescence process for preparing custom color toners by blending different amounts of pigment dispersions, highlight colors particles, and the like, and wherein the pigments have been dispersed in certain water soluble surfactants, such as Surfynol, that are easily removable by washing with water, hence exhibiting (i) excellent projection efficiency, and (ii) similar triboelectrical charging behavior.

In another object of the present invention there are provided processes for the preparation of a combination of four toners comprised of resin and pigment, and wherein each toner can be of a preselected size, such as from about 1 to about 10 microns in volume average diameter, and with narrow GSD by the aggregation of latex or emulsion particles, which aggregation can be accomplished with stirring at a temperature in excess of 25° C., and below about the Tg of the toner resin, for example at 50° C., followed by addition of further stabilizer, for example anionic surfactant, followed by heating the formed aggregates above about the resin Tg to allow for coalescence; an essentially three step process of blending, aggregation and coalescence; and which process can in embodiments be completed in 8 or less hours. The emulsion/aggregation process is illustrated in U.S. Pat. Nos. 5,403,693 and 5,364,729. The process can comprise dispersing pigment particles in a water/cationic surfactant mixture using a microfluidizer; blending the dispersion with a latex using a SD41 mixer, which allows continuous pumping and shearing at high speeds, which is selected to break initially formed flocks or flocs, thus allowing controlled growth of the particles and improved particle size distribution. The pigment/latex blend is then transferred into a kettle equipped with a mechanical stirrer and a temperature probe, and heated up to 45° C. or 50° C. to perform the aggregation. Extra anionic surfactant can be added to stabilize the aggregates during the coalescence step. The resulting aggregated particles are heated 20° to 50° C. above their polymer Tg to permit coalescence, and the resulting particles are filtered and washed with water to remove the surfactants. The toner particles can then be dried in a freeze dryer, spray dryer, or fluid bed dryer.

Another object of the invention is the provision of toners with excellent triboelectric characteristics, acceptable admix values of, for example, from about 15 to about 60 seconds, wide color gamut, high gloss, excellent projection efficiency, and to provide toner particles having similar charging behavior.

These and other objects of the present invention are accomplished in embodiments by the provision of toners and processes thereof. In embodiments of the present invention, there are provided processes for the economical direct preparation of a combination of toners, and wherein each toner is obtained by flocculation or heterocoagulation and coalescence, and wherein the temperature of aggregation can be utilized to control the final toner particle size, that is average volume diameter.

In embodiments, the present invention is directed to processes for the preparation of toner compositions which comprise initially attaining or generating a nonionic pigment dispersion, for example an aqueous dispersion mixture of a pigment or pigments, such as carbon SUNSPERSE BLACK® containing REGAL 330®, SUNSPERSE BLUE® containing phthalocyanine, SUNSPERSE RED® containing quinacridone or RHODAMINE B™, SUNSPERSE YELLOW® containing pigment yellow 17, with Surfynol surfactants or grinding aids, by known dispersion methods, such as attrition, microfluidization, or high speed homogenization. This pigment dispersion is then introduced into a water/cationic surfactant mixture, such as benzalkonium chloride, and mixed with the latex by utilizing a high shearing device, such as a Brinkmann Polytron, or microfluidizer. The latex can be comprised of suspended resin particles, such as poly(styrene butadiene) acrylic acid or poly(styrene butylacrylate) acrylic acid, and wherein the particle size of the suspended resin mixture is, for example, from about 0.01 to about 0.5 micron in an aqueous surfactant mixture containing an anionic surfactant, such as sodium dodecylbenzene sulfonate and nonionic surfactant, such as nonylphenol or octylphenol ethoxylate, resulting in a flocculation, or heterocoagulation of the polymer or resin particles with the pigment particles, followed by further stirring of the mixture while heating below about the resin Tg, for example from about 5° to about 15° C., and allowing the formation of electrostatically stabilized aggregates ranging from about 0.5 micron to about 10 microns; followed by the addition of extra stabilizer, such as anionic surfactant, subsequently heating above about the resin Tg, for example from about 5 to about 50° C., to cause coalescence of the latex, pigment particles, washing with water to remove, for example, surfactants, and drying, such as by use of an Aeromatic fluid bed dryer, freeze dryer, or spray dryer; whereby toner particles comprised of resin and pigment, and optional additives with various particle size diameters can be obtained, such as from about 1 to about 10 microns in average volume particle diameter as measured by the Coulter Counter.

Embodiments of the present invention include a process for the preparation of a combination of toner compositions comprised of resin and pigment, and wherein each toner of the combination is prepared as follows:

(i) preparing a pigment mixture containing water, cationic surfactant, optional additives and a predispersed pigment, which is comprised of a finely divided pigment in a nonionic surfactant, and which surfactant is water water soluble;

(ii) shearing the pigment dispersion with a latex mixture comprised of polymeric or resin particles in water and anionic surfactant, and a nonionic surfactant;

(iii) heating the resulting sheared mixture below the resin Tg, for example 40° to about 50° C. (or 5° to 20° C. below the resin Tg), thereby causing flocculation or heterocoagulation of the formed particles of pigment, resin and optional additives to form electrostatically bound toner size aggregates;

(iv) adding more anionic stabilizer in the amounts of, for example, from about 0.2 to about 3 percent by weight of water to retain the particle size and GSD during step (v); and (v) heating to, for example, from about 60° to about 95° C. the electrostatically bound toner size aggregates of (iii) to form a toner composition comprised of polymeric resin and pigment.

Also, in embodiments the present invention is directed to processes for the preparation of a combination of four toner compositions which comprise (i) preparing a mixture of pigment, such as carbon black like REGAL 330®, HOSTAPERM PINK™, or PV FAST BLUE™ and Yellow 17, reference the Color Index, which are predispersed in a Surfynol nonionic surfactant or grinding aid, and wherein the pigment loading is in the order of from about 2 to about 14 percent by weight of toner, in an aqueous mixture containing a cationic surfactant, such as dialkylbenzene dialkylammonium chloride like SANIZOL B-50™ available from Kao or MIRAPOL™ available from Alkaril Chemicals, and from about 0.5 to about 2 percent by weight of water utilizing a high shearing device such as a Brinkmann Polytron or IKA homogenizer; (ii) adding the aforementioned pigment mixture to an aqueous suspension of resin particles comprised of, for example, poly(styrene-butylmethacrylate acrylic acid), PLIOTONE™, a poly (styrene-butadiene) available from Goodyear Chemicals, and which resin particles are present in various effective amounts, such as from about 40 percent to about 98 percent (or parts) by weight of the toner, and wherein the polymer resin latex particle size is from about 0.07 micron to about 1 micron in volume average diameter, and an anionic surfactant like sodium dodecylsulfate, dodecylbenzene sulfonate or NEOGEN R™ from about 0.5 to about 3 percent by weight of water, a nonionic surfactant, such polyethylene glycol or polyoxyethylene glycol nonyl phenyl ether or IGEPAL 897™ obtained from GAF Chemical Company, from about 0.5 to about 3 percent by weight of water, thereby causing a flocculation or heterocoagulation of pigment, optional additive and resin particles; (iii) diluting the mixture with water to enable from about 40 percent to about 15 percent of solids; (iv) homogenizing the resulting flocculent mixture with a high shearing device, such as a Brinkmann Polytron or IKA homogenizer, operating at a speed of from about 3,000 revolutions per minute to about 10,000 revolutions per minute for a duration of from about 1 minute to about 120 minutes, thereby resulting in a homogeneous mixture of latex and pigment, and further stirring while heating to below the resin Tg, for example about 5° to 20° C. below the resin Tg at temperatures of about 35° to 50° C., to form electrostatically stable aggregates of from about 1.0 micron to about 10 microns in average volume diameter; (v) adding additional anionic surfactant or nonionic surfactant in the amount of from 0.5 percent to 5 percent by weight of water to stabilize the aggregates formed in step (iv), heating the resultant electrostatically bound aggregate composite particles at from about 60° C. to about 135° C. for a duration of about 60 minutes to about 600 minutes to form toner sized particles of from about 1 micron to about 10 microns in volume average diameter and with a geometric size distribution of from about 1.2 to about 1.3 as measured by the Coulter Counter; and (vi) isolating the toner sized particles by washing, filtering and drying thereby providing toner particles comprised of resin, pigment, and optional additives, such as charge enhancing additives. Flow additives to improve the toner flow characteristics and charge additives, if not initially present, to improve charging characteristics may then be added by blending with the formed toner, such additives including AEROSILS® or fumed silicas, metal oxides like tin, titanium and the like, metal salts of fatty acids, like zinc stearate, and which additives are present in various effective amounts, such as from about 0.1 to about 10 percent by weight of the toner.

Methods of obtaining the pigment mixtures depend on the form of the pigment utilized, for example in some instances, pigments available in a predispersed form in which case can be easily dispersed utilizing a homogenizer or stirring. In other instances, pigments utilized in a dry or in the wet cake form are dispersed in water and a surfactant, preferably a cationic or nonionic surfactant using microfluidization equipment, such as, for example, a M-110 microfluidizer, and passing the pigment dispersion from 1 to 10 times through the chamber of the microfluidizer.

Illustrative examples of specific resin particles, resins or polymers selected for the process of the present invention include known polymers such as poly(styrene-butadiene), poly(para-methyl styrene-butadiene), poly(meta-methyl styrene-butadiene), poly(alpha-methyl styrene-butadiene), poly(methylmethacrylate-butadiene), poly (ethylmethacrylate-butadiene), poly(propylmethacrylate-butadiene), poly(butylmethacrylate-butadiene), poly (methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly (alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene); polymers such as poly (styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE™ (Reichhold Chemical Inc.), a polyester resin, PLASTHALL™ (Rohm & Hass), a polyester, CYGLAS™ (American Cyanamide), a polyester molding compound, ARMCO™ (Armco Composites), a polyester, CELANEX™ (Celanese Eng), a glass reinforced thermoplastic polyester, RYNITE™ (DuPont), a thermoplastic polyester, STYPOL™ (Freeman Chemical Corporation), a polyester with styrene monomer, and the like. The resin selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid) can be selected as the toner resin.

The resin selected for the process of the present invention is preferably prepared by emulsion polymerization methods, and the monomers utilized in such processes include styrene, acrylates, methacrylates, butadiene, isoprene, and optionally, but preferably acid or basic olefinic monomers, such as acrylic acid, methacrylic acid, acrylamide, methacrylamide, quaternary ammonium halide of dialkyl or trialkyl acrylamides, or methacrylamide, vinylpyridine, vinylpyrrolidone, vinyl-N-methylpyridinium chloride, and the like. The acid or basic groups can be present in various effective amounts, such as from about 0.1 to about 10 percent by weight of the polymer resin. Known chain transfer agents, for example dodecanethiol, about 1 to about 10 percent, or carbon tetrabromide and the like in effective amounts, such as from about 1 to about 10 percent, can also be selected when preparing the resin particles by emulsion polymerization.

Various known colorants or pigments present in each toner in an effective amount of, for example, from about 1 to about 25 percent by weight of the toner, and preferably in an amount of from about 1 to about 15 weight percent, that can be selected include those illustrated, for example, in the Color Index, such as carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments, reference the Color index, include phthalocyanine HELIOGEN BLUE L6900™, D6840™, D7080™, D7020™, PYLAM OIL BLUE™, PYLAM OIL YELLOW™, PIGMENT BLUE 1TM available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, CI Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight and preferably from about 2 to about 12 percent, of the toner.

The cyan pigment can be Pigment Blue 15:3 having a Color Index Constitution Number of 74160, the magenta pigment can be Pigment Red 81:3 having a Color Index Constitution Number of 45160:3, the yellow pigment can be Yellow 17 having a Color Index Constitution Number of 21105; and wherein the cyan or blue, the magenta and the yellow pigments are represented by the following formulas

C.I. 74160: PIGMENT BLUE 15:3

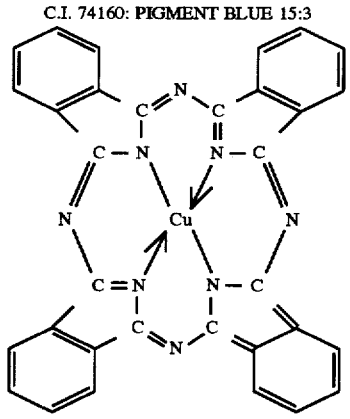

C.I. 45160:3: PIGMENT RED 81:3

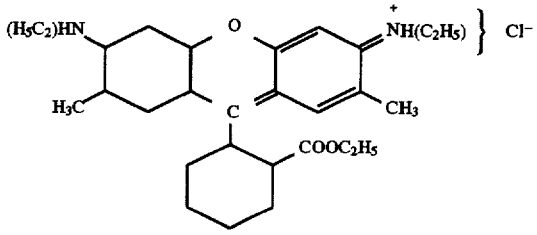

SILICOMOLYBDIC ACID SALT
C.I. 21105: PIGMENT YELLOW 17

-continued

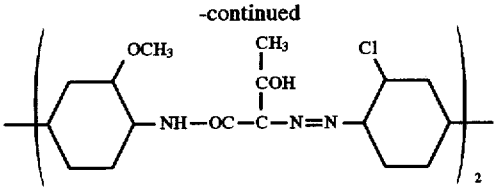

wherein each of the pigments are present in an amount of from about 2 to about 25 weight percent based on the weight percent of resin and pigment; wherein each of the pigments are present in an amount of from about 2 to about 15 weight percent based on the weight percent of resin and pigment; wherein each of said cyan, magenta, yellow and black pigments possesses a diameter particle size or agglomerate diameter size of from about 0.01 micron to about 3 microns; wherein each of said cyan, magenta, and yellow pigments is of a particle diameter size or agglomerate diameter size of from about 0.01 micron to about 0.3 micron, and the black pigment is of a particle diameter size of from about 0.001 micron to about 0.1 micron; wherein each of said cyan, magenta, and yellow pigments has a particle diameter size or agglomerate diameter size of from about 0.01 micron to about 0.3 micron, and said pigments are dispersed into said toner resin uniformly to thereby minimize light scattering and increase color gamut in reflection copy and overhead transparency copy. A combination set, or gamut of four color toners, each for the development of electrostatic latent images enabling the formation of a full color gamut image, and wherein the four toners are comprised of a cyan toner, a magenta toner, a yellow toner, and a black toner, each of said toners being comprised of resin and pigment, and wherein the pigment for the cyan toner is a β-copper phthalocyanine, the pigment for the magenta toner is a xanthene silicomolybdic acid salt of Rhodamine 6G basic dye, the pigment for the yellow toner is a diazo benzidine, and the pigment for the black toner is carbon black; a combination of toners wherein the fused image obtained with said toner combination has a Gardner Gloss value of from about 60 to 90 gloss units, wherein from about 70 to about 98 percent of the transmitted light passing through said fused image contained on a transparency reaches a projection screen from an overhead projector; and an imaging process which comprises the generation of an electrostatic image on a photoconductive imaging member followed by the development thereof with a combination, set, or gamut of toners, and wherein four toners are selected, which toners are comprised of a cyan toner, a magenta toner, a yellow toner, and a black toner, each of said toners being comprised of resin and pigment, and wherein the pigment for the cyan toner is a β-copper phthalocyanine, the pigment for the magenta toner is a xanthene silicomolybdic acid salt of Rhodamine 6G basic dye, the pigment for the yellow toner is a diazo benzidine, and the pigment for the black toner is carbon black; thereafter, transferring the developed image to a substrate, and fixing the image thereto.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Examples of surfactants selected for the invention pigment dispersion are as illustrated herein, and more specifically, include water soluble surfactants, such as the Surfynol(s) available from Air Products and Chemical Inc. with aliphatic hydroxy groups, and more specifically, Surfynol 104 and Surfynol GA. The Surfynol 104 is, according to Air Products and Chemical Inc., 2,4,7,9-tetramethyl-5 decyne-4,7-diol containing isopropyl alcohol, about 50 parts of the diol and about 50 parts of the isopropyl alcohol, and the Surfynol 104 includes Surfynols 104BC, 104E, 104H, 104 PA. According to Air Products and Chemical Inc., the aforementioned 104BC is 2,4,7,9-tetramethyl-5 decyne-4,7-diol containing 2-butoxyethanol, the 104E is 2,4,7,9-tetramethyl-5 decyne-4,7-diol containing ethylene glycol, the 104H is 2,4,7,9-tetramethyl-5 decyne-4,7-diol containing ethylene glycol, and the 104PA is 2,4,7,9-tetramethyl-5 decyne-4,7-diol containing isopropyl alcohol. Also, according to Air Products and Chemical Inc., the supplier, the Surfynol GA is comprised of from about 10 to about 35 parts of 2,4,7,9-tetramethyl-5 decyne-4,7-diol, about 22 parts of 1,2 ethanediol, and from about 30 to about 60 parts of alkyarylalkoxylates.

Surfactants, other than the pigment water soluble surfactants, selected in amounts of, for example, 0.1 to about 25 weight percent in embodiments include, for example, nonionic surfactants such as dialkylphenoxypoly (ethyleneoxy) ethanol, available from Rhone-Poulenac as IGEPAL CA-210™, IGEPAL CA-520™, IGE PAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0.01 to about 10 percent by weight, and preferably from about 0.1 to about 5 percent by weight of monomers, used to prepare the copolymer resin.

Examples of ionic surfactants include anionic and cationic with examples of anionic suffactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight, of water. Preferably, the molar ratio of the cationic surfactant used for flocculation to the anionic surfactant used in the latex preparation is in the range of from about 0.5 to 4, and preferably from 0.5 to 2.

Weight percent throughout also includes parts in embodiments of the present invention.

Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of the surfactant, which are added to the aggregated particles to "freeze" or retain particle size, and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregates comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof, and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSII R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

Prior art pigment dispersions often contain the surfactants grafted onto the pigment particle as indicated herein, and this grafting prevents the surfactant from being easily removed with water, if it can be removed. When these types of pigment dispersions are employed to prepare pigmented toner particles by emulsion aggregation (E/A) process, there results particles, or toners with nonremovable suffactants. Thus, although the aforementioned toners are thoroughly washed, the toner particles exhibit "little to none charging behavior", especially the Red 81.3, the Yellow 17 and the carbon black dispersions. Similar relatively stable toner triboelectrical charging behavior of the invention results primarily from (i) the removal of the surfactants or pigment grinding aids employed in the pigment dispersion, (ii) the removal of anionic (NEOGEN R™—sodium dodecylbenzene sulfonate), nonionic (ANTAROX CA 897™) and the cationic (SANIZOL B™—benzalkonium chloride) surfactants employed in the emulsion aggregation process, (iii) the pigment being buried in the resin particle and, therefore, the complex pigment chemistry does not substantially interfere with the charging performance of the toner particle, unlike the toner particles prepared by melt mix process, and unlike toners prepared with surfactants that bind to the pigment as indicated herein.

The following Examples are being submitted to further define various species of the present invention. These Examples are intended to be illustrative only and are not intended to limit the scope of the present invention. Also, parts and percentages are by weight unless otherwise indicated.

EXAMPLE

Latex Synthesis:

A polymeric or emulsion latex was prepared by the emulsion polymerization of styrene/butylacrylate/acrylic acid (82/18/2 parts) in a nonionic/anionic surfactant solution (3 percent) as follows. 656 Grams of styrene, 144 grams of butyl acrylate, 16 grams of acrylic acid, 28 grams (3.5 percent) of dodecanethiol, and 8 grams of carbon tetrabromide were mixed with 1,100 milliliters of deionized water in which 18 grams of sodium dodecyl benzene sulfonate anionic surfactant (NEOGEN R™ which contains 60 percent of active component), 17.2 grams of polyoxyethylene nonyl phenyl ether—nonionic surfactant (ANTAROX 897™—70 percent active), and 8 grams of ammonium persulfate initiator were dissolved in 100 grams of water, which was added to the above. The emulsion was then polymerized at 70° C. for 6 hours. The resulting latex, 60 percent water and 40 percent (weight percent throughout) solids, was comprised of a copolymer of polystyrene/polybutyl acrylate/polyacrylic acid, 88/12/2; the Tg of the latex dry sample was 60° C., as measured on a DuPont DSC; $M_w$=22,500, and $M_n$=6,000 as determined on a Hewlett Packard 6PC. The zeta potential was measured on Pen Kern Inc. The Laser Zee Meter was −95 millivolts for this polymeric latex. The particle size of the latex as measured on Brookhaven BI-90 Particle Nanosizer was 136 nanometers.

Toner Triboelectric Charge Evaluation:

In 120 milliliter glass bottles, 1 gram of toner was added to 24 grams of carrier particles comprised of 65 micron steel particles coated with a mixture of 20 percent by weight of Vulcan carbon black and 80 weight percent of polymethylmethacrylate, coating weight of 1 percent. For each combination of toner and carrier, the above developer mixture was retained in an environmental chamber at either 20 percent relative humidity, 50 percent relative humidity, or at 80 percent relative humidity overnight, about 18 hours. The bottles were then sealed, and the toner and carrier particles were mixed by roll milling for 30 minutes to obtain a stable triboelectric charge. The toner charge was measured using the standard tribo blow-off apparatus.

Toner charging admix was determined by selecting a developer that had been charged at 50 percent RH, as described above, and adding a further 1 gram of the above prepared uncharged toner. The developer was then further roll milled and examined using a charge spectrograph after 15 seconds, 30 seconds, and 1 minute of mixing. The admix time is the time at which the added uncharged toner has obtained the same charge as the original charged toner.

TONER PREPARATION

Preparation of Cyan (3.5 percent) Toner Particle—T868:

7.6 Grams of BHD 6000 (53 percent solids) SUNSPERSE BLUE™ pigment, which pigment is comprised of 15:3 copper phthalocyanine pigment, which is dispersed in a mixture of water and in the surfactant Surfynol GA obtained from Air Products, and comprised of from about 10 to about 35 parts of 2,4,7,9-tetramethyl-5 decyne-4,7-diol, about 22 parts of 1,2 ethanediol, and from about 30 to about 60 parts of alkyarylalkoxylates, was dispersed in 240 milliliters of deionized water containing 2.34 grams of alkylbenzyldimethyl ammonium chloride cationic surfactant (SANIZOL B™) by stirring. This cationic dispersion of the pigment was then simultaneously added with 260 grams of the above prepared Latex A (40 percent solids) containing 2.3 grams of anionic surfactant and 400 grams of water while being homogenized with an IKA G45M probe for 3 minutes at 5,000 rpm. This mixture was then transferred into a reaction kettle and its temperature raised to 50° C. while being stirred. A sample taken after 2.5 hours indicated the particles had a size of 7.3 microns with a GSD of 1.17. 40 Milliliters of 20 percent (W/W) anionic surfactant solution were then added to the aggregates to prevent any further growth, and the temperature of the reactor raised further to 93° C. and held there for 4 hours to complete the coalescence. This resulted in a cyan toner particle of 7.3 microns with a GSD of 1.18 and comprised of 96.3 weight percent of poly (styrene-co-butylacrylate-co-acrylic acid) resin, and 3.5 percent of SUNFAST BLUE™ pigment. The toner particles were washed with deionized water several times and freeze dried. The resulting toner tribo was 14.7 μC/gram.

Preparation of Magenta (5 percent) Toner Particle—T875:

24 Grams of 4-88B (21 percent solids of 81.3) red dispersion pigment, which pigment is comprised of 81:3 red pigment which is dispersed in a mixture of water and in the surfactant Surfynol GA obtained from Air Products, were dispersed in 220 milliliters of deionized water containing 2.34 grams of alkylbenzyldimethyl ammonium chloride cationic surfactant (SANIZOL B™ ) by stirring. This cationic dispersion of the pigment was then simultaneously added with 260 grams of the above prepared Latex A (40 percent solids) containing 2.3 grams of anionic surfactant and 350 grams of water while being homogenized with an IKA G45M probe for 3 minutes at 5,000 rpm. This mixture was then transferred into a reaction kettle, and the temperature of the kettle was increased to 50° C. while being stirred. A sample taken from the kettle after 2 hours indicated a particle size of 6.3 microns with a GSD of 1.17. 45 Milliliters of 20 percent (W/W) anionic surfactant solution were then added to the aggregates in the kettle to prevent any further growth, and the temperature of the reactor was increased further to 93° C. and retained at this temperature for 4 hours to complete the coalescence. There resulted a cyan toner of 6.6 microns with a GSD of 1.19, and comprised of 95 weight percent of poly(styrene-co-butylacrylate-co-acrylic acid) resin, and 5.0 percent of magenta pigment. The toner particles were washed with deionized water several times and freeze dried. The resulting tribo was 13.7 μC/gram (microcoulombs per gram).

Preparation of Yellow (10 percent) Toner Particle—T876:

45 Grams of 4-92B (21 percent solids of Y.17) Yellow 17 dispersion pigment, which pigment is comprised of Yellow 17 pigment which is dispersed in a mixture of water and in the surfactant Surfynol GA obtained from Air Products, were dispersed in 220 milliliters of deionized water containing 2.6 grams of alkylbenzyldimethyl ammonium chloride cationic surfactant (SANIZOL B™ ) by stirring. This cationic dispersion of the pigment was than simultaneously added with 260 grams of the above prepared Latex A (40 percent solids) containing 2.3 grams of artionic surfactant and 350 grams of water while being homogenized with an IKA G45M probe for 3 minutes at 5,000 rpm. This mixture was then transferred into a reaction kettle, and the kettle temperature was increased to 50° C. while the kettle contents were being stirred. A sample taken from the kettle after 2 hours indicated a particle size of 6.6 microns with a GSD of 1.18. 55 Milliliters of 20 percent (W/W) artionic surfactant solution were then added to the aggregates to prevent any further growth, and the temperature of the reactor was raised further to 93° C. and held there for 4 hours to complete the coalescence. There resulted a cyan toner of 7.1 microns with a GSD of 1.21, and comprised of 90 weight percent of poly(styrene-co-butylacrylate-co-acrylic acid) resin, and 10.0 percent of Yellow 17 pigment. The toner particles were washed with deionized water several times and freeze dried. The resulting toner tribo (toner tribo throughout unless otherwise indicated) was 14.2 μC/gram.

Preparation of Black Toner Particle—T905:

26.6 Grams of 10-1 (21 percent solids of REGAL 330®) carbon black dispersion pigment, which pigment is comprised of REGAL 330®carbon black, which is dispersed in a mixture of water and in the surfactant Surfynol GA obtained from Air Products, were dispersed in 220 milliliters of deionized water containing 2.6 grams of alkylbenzyldimethyl ammonium chloride cationic surfactant (SANIZOL B™ ) by stirring. The resulting cationic dispersion of the pigment was then simultaneously added with 260 grams of the above prepared Latex A (40 percent solids) containing 2.3 grams of anionic surfactant and 350 grams of water while being homogenized with an IKA G45M probe for 3 minutes at 5,000 rpm. This mixture was then transferred into a reaction kettle, and its temperature was raised to 50° C. while being stirred. A sample taken from the kettle after 2 hours indicated a tone particle size of 6.7 microns with a GSD of 1.18. 55 Milliliters of 2 percent (W/W) anionic surfactant solution were added to the aggregates to prevent any further growth, and the temperature of the reactor raised further to 93° C. and held there for4 hours to complete the coalescence. This resulted in a cyan toner of 6.8 microns with a GSD of 1.20 and comprised of 95 weight percent of poly(styrene-co-butylacrylate-co-acrylic acid) resin, and 5.0 percent of REGAL 330®carbon black pigment. The toner particles obtained were then washed with deionized water several times and freeze dried. The resulting tribo was 12.5 μC/gram.

In the above toner preparation Examples, washing with water removed the Surfynol GA surfactant.

Similarly, 7 microns of cyan, magenta, and yellow pigmented toner particles containing styrene-isoprene and acrylic acid (84:16:2 pph) were synthesized and evaluated for tribo. The results are reported in the Tables that follow.

In Table 1, C represents the cyan toner containing the Surfynol GA surfactant, and Y, M, and K represent the yellow toner, the magenta toner, and the black toner, respectively, and wherein each of these toners, Y, M, and K, do not contain the Surfynol GA surfactant. S/BA/AA refers to the toner resin styrene/butylacrylate/acrylic acid (82/18/2). In Table 2 each of the toners, cyan (C), yellow (Y), magenta (M), and black (K) contain the Surfynol GA surfactant, and S/BA/AA refers to the toner resin styrene/butylacrylate/acrylic acid (82/18/2). Similar designations are used in Table 3, and wherein the Surfynol GA surfactant is contained in each of the toners and S/IP/AA refers to styrene/isoprene/acrylic acid toner resin.

TABLE 1

| In Situ S/BA/AA Toners | | | | |
|---|---|---|---|---|
| Pigment | C | Y | M | K |
| Toner Q/M (μC/g) | −14.7 | −1.7 | −3.6 | −1.6 |

TABLE 2

| In Situ S/BA/AA Toners With GA Pigments - 20% RH | | | | |
|---|---|---|---|---|
| Pigment | C | Y | M | K |
| Toner Q/M (μC/g) | −14.7 | −14.2 | −13.5 | −12.5 |

TABLE 3

| In Situ S/IP/AA Toners with GA Pigments - 20% RH | | | |
|---|---|---|---|
| Pigment | C | Y | M |
| Toner Q/M (μC/g) | −42 | −33 | −31 |

At other higher RH (relative humidity) percentages, it was found that the toners with the GA surfactant pigment component possessed substantially stable negative triboelectric toner charging values.

Other modifications of the present invention may occur to those skilled in the art subsequent to a review of the present application and these modifications, including equivalents thereof, are intended to be included within the scope of the present invention.

What is claimed is:

1. A process for the preparation of a combination of color toners comprised of a cyan toner, a magenta toner, a yellow toner, and a black toner, each of said toners being comprised of resin and pigment, and wherein the pigment is cyan, magenta, yellow and black, each of the said pigments are dispersed in a nonionic, or neutral charge surfactant, and wherein each toner in the combination is prepared by (i) preparing a pigment dispersion, which dispersion is comprised of a pigment and a surfynol nonionic water soluble surfactant;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates; and (iv) heating said bound toner size aggregates above about the Tg of the resin.

2. A process for the preparation of a combination of four colored toners for the development of electrostatic latent images enabling the formation of a full color gamut image, and wherein the four toners are comprised of a first cyan toner, a second magenta toner, a third yellow toner, and a fourth black toner, each of said toners being comprised of resin and pigment, and wherein the pigment is cyan, magenta, yellow and black, and wherein each toner in the combination is prepared by (i) providing a pigment dispersion, which dispersion is comprised of a pigment, and the nonionic water soluble surfactant 2,4,7,9-tetramethyl-5 decyne-4,7-diol containing isopropyl alcohol, 2,4,7,9-tetramethyl-5 decyne-4,7-diol containing 2-butoxyethanol, 2,4,7,9-tetramethyl-5 decyne-4,7-diol containing ethylene glycol, or a mixture comprised of 2,4,7,9-tetramethyl-5 decyne-4,7-diol, ethanediol, and alkyarylalkoxylates;

(ii) preparing a pigment mixture comprised of said pigment dispersion, water and a water soluble cationic surfactant;

(iii) shearing said pigment mixture with a latex or emulsion blend comprised of thermoplastic resin, a anionic surfactant and a nonionic surfactant;

(iv) heating the above sheared blend of (iii) below the glass transition temperature (Tg) of the resin to form electrostatically bound toner size aggregates;

(v) adding further anionic surfactant to stabilize the toner size aggregates, and retain the particle size and GSD upon further heating; and (vi) heating said toner sized bound aggregates above the Tg of the resin, cooling, and washing to enable removal of said surfactants.

3. A process in accordance with claim 2 wherein the triboelectrical charge for each toner is similar.

4. A process in accordance with claim 2 wherein upon changing the latex polymeric resin the toner continues to possess a similar triboelectrical charge for each toner.

5. A process in accordance with claim 2 wherein the triboelectrical charge for each toner is from about 15 to about 45 microcoulombs per gram.

6. A process in accordance with claim 2 wherein the triboelectrical charge for each toner is from about 20 to about 35 microcoulombs per gram.

7. A process in accordance with claim 2 wherein the nonionic water soluble surfactant of (i) is present in an amount of from about 0.5 to about 20 weight percent.

8. A process in accordance with claim 2 wherein the cyan toner contains the cyan pigment, a phthalocyanine blue C.I 74160, the yellow toner contains the yellow pigment, a Diarylide AAOA Yellow 17 C.I 21105, the magenta toner contains the magenta pigment Rhodamine 81.3 C.I 45160:3, and the black toner contains as a pigment carbon black.

9. A process in accordance with claim 2 wherein the pigment is present in an amount of about 2 to about 20 weight percent based on the polymeric resin weight.

10. A process in accordance with claim 2 wherein the pigment is present in an amount of about 3 to about 15 weight percent based on the polymeric resin weight.

11. A process in accordance with claim 2 wherein the size of said aggregates can be increased to from about 2.5 to about 10 microns by increasing the temperature of heating in (iii) to from about room temperature to about 50° C.

12. A process in accordance with claim 2 wherein the particle size distribution of the aggregated particles is narrower, about 1.40 decreasing to about 1.16, when the temperature is increased from room temperature to 50° C., and wherein said temperature is below the resin Tg.

13. A process in accordance with claim 1 wherein the heating of the blend of latex, pigment, surfactants and optional additives in (i/i) is accomplished at temperatures of from about 20° C. to about 5° C. below the Tg of the resin for a duration of from about 0.5 hour to about 6 hours.

14. A process in accordance with claim 1 wherein the heating of the statically bound toner sized aggregate particles to form toner size composite particles comprised of pigment, and resin is accomplished at a temperature of from about 10° C. above the Tg of the resin to about 95° (2 for a duration of from about I hour to about 8 hours.

15. A process in accordance with claim 1 wherein the resin is selected from the group consisting of poly(styrene-butadiene), poly(para-methylstyrene-butadiene), poly(meta-methylstyrene-butadiene), poly(alpha-methylstyrene-butadiene), poly(methylmethacrylate-butadiene), poly (ethylmethacrylate-butadiene), poly(propylmethacrylate-butadiene), poly(butylmethacrylate-butadiene), poly (methylacrylate-butadiene), poly(ethylacrylate-butadiene), poly(propylacrylate-butadiene), poly(butylacrylate-butadiene), poly(styrene-isoprene), poly(para-methylstyrene-isoprene), poly(meta-methylstyrene-isoprene), poly(alpha-methylstyrene-isoprene), poly (methylmethacrylate-isoprene), poly(ethylmethacrylate-isoprene), poly(propylmethacrylate-isoprene), poly (butylmethacrylate-isoprene), poly(methylacrylate-isoprene), poly(ethylacrylate-isoprene), poly (propylacrylate-isoprene), and poly(butylacrylate-isoprene).

16. A process in accordance with claim 1 wherein the resin is selected from the group consisting of poly(styrene-butadiene-acrylic acid), poly(styrene-butadiene-methacrylic acid), poly(styrene-butylmethacrylate-acrylic acid), poly (styrene-butylacrylate-acrylic acid), polyethylene-terephthalate, polypropylene-terephthalate, polybutylene-terephthalate, polypentylene-terephthalate, polyhexalene-terephthalate, polyheptadene-terephthalate, polystyrene-butadiene, and polyoctalene-terephthalate.

17. A process in accordance with claim 2 (iii) wherein for the preparation of the latex, the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly (ethyleneoxy) ethanol.

18. A process in accordance with claim 2 wherein the anionic surfactant is selected from the group consisting of sodium dodecyl sulfate, sodium dodecylbenzene sulfate and sodium dodecylnaphthalene sulfate.

19. A process in accordance with claim 2 wherein the cationic surfactant is a quaternary ammonium salt.

20. A process in accordance with claim 2 wherein the resin utilized in (iii) is from about 0.03 to about 0.08 micron in average volume diameter; and the pigment particles are from about 0.01 to about 0.08 micron in volume average diameter.

21. A process in accordance with claim 2 wherein the toner particles isolated are from about 2 to about 15 microns in average volume diameter, and the geometric size distribution thereof is from about 1.15 to about 1.35.

22. A process in accordance with claim 2 wherein there is added to the surface of the formed toner metal salts, metal salts of fatty acids, silicas, metal oxides, or mixtures thereof, in an amount of from about 0.1 to about 10 weight percent of the obtained toner particles.

23. A process in accordance with claim 2 wherein the toner is washed with warm water at a temperature of from about 40° to about 60° C., and the surfactants are removed from the toner surface, followed by drying.

24. A process in accordance with claim 2 wherein heating in (iii) is from about 5° C. to about 25° C. below the Tg.

25. A process in accordance with claim 2 wherein heating in (iii) is accomplished at a temperature of from about 29° to about 59° C.

26. A process in accordance with claim 2 wherein the resin Tg in (iii) is from about 50° to about 80° C.

27. A process in accordance with claim 2 wherein heating in (iv) is from about 5° to about 50° C. above the Tg.

28. A process for the preparation of a combination of color toners comprised of a cyan toner, a magenta toner, a yellow toner, and a black toner, each of said toners being comprised of resin and pigment, and wherein the pigment is cyan, magenta, yellow and black, each of said pigments are dispersed in a neutral charge water soluble surfactant, which surfactant is readily removable with water washing, and wherein each toner in the combination is prepared by (i) preparing a pigment dispersion, which dispersion is comprised of a pigment and a surfynol water soluble nonionic surfactant;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates with a narrow particle size distribution; and (iv) heating said bound aggregates above about the Tg of the resin, and optionally washing and drying.

29. A process in accordance with claim 28 wherein the water soluble surfactant is 2,4,7,9-tetramethyl-5 decyne-4, 7-diol containing isopropyl alcohol.

30. A process in accordance with claim 28 wherein the water soluble surfactant is 2,4,7,9-tetramethyl-5 decyne-4, 7-diol containing 2-butoxyethanol.

31. A process in accordance with claim 28 wherein the water soluble surfactant is 2,4,7,9-tetramethyl-5 decyne-4, 7-diol containing ethylene glycol.

32. A process in accordance with claim 28 wherein the surfactant is comprised of from about 10 to about 35 parts of 2,4,7,9-tetramethyl-5 decyne-4,7-diol, about 22 parts of 1,2 ethanediol, and from about 30 to about 60 parts of alkyarylalkoxylates.

33. A process in accordance with claim 2 wherein the surfactant is comprised of from about 10 to about 35 parts of 2,4,7,9-tetramethyl-5 decyne-4,7-diol, about 22 parts of 1,2 ethanediol, and from about 30 to about 60 parts of alkyarylalkoxylates.

34. A process for the preparation of a combination of four colored toners for the development of electrostatic latent images enabling the formation of a full color gamut image, and wherein the four toners are comprised of a first cyan toner, a second magenta toner, a third yellow toner, and a fourth black toner, each of said toners being comprised of resin and pigment, and wherein the pigment is cyan, magenta, yellow and black, and wherein each toner in the combination is prepared by (i) providing a pigment dispersion, which dispersion is comprised of a pigment, and the nonionic water soluble surfactant mixture comprised of 2,4,7,9-tetramethyl-5 decyne-4,7-diol, ethanediol, and alkyarylalkoxylates;

(ii) preparing a pigment mixture comprised of said pigment dispersion, water and a water soluble cationic surfactant;

(iii) shearing said pigment mixture with a latex or emulsion blend comprised of thermoplastic resin, an anionic surfactant and a nonionic surfactant;

(iv) heating the above sheared blend of (iii) below the glass transition temperature (Tg) of the resin to form electrostatically bound toner size aggregates with a narrow particle size distribution;

(v) adding further anionic surfactant to stabilize the toner size aggregates, and retain the particle size and GSD upon further heating; and (vi) heating said toner sized bound aggregates above the Tg of the resin, and optionally cooling, and washing to enable removal of said surfactants.

35. A process in accordance with claim 34 wherein the surfactant is comprised of from about 10 to about 35 parts of 2,4,7,9-tetramethyl-5 decyne-4,7-diol, about 22 parts of 1,2 ethanediol, and from about 30 to about 60 parts of alkyarylalkoxylates.

36. A process for the preparation of a combination of color toners comprised of a cyan toner, a magenta toner, a yellow toner, and a black toner, each of said toners being comprised of resin and colorant, and wherein the colorant is cyan, magenta, yellow and black, each of the said colorants are dispersed in a nonionic, or neutral charge surfactant, and wherein each toner in the combination is prepared by shearing a colorant dispersion with a latex or emulsion blend comprised of resin, a counterionic surfactant with a charge polarity of opposite sign to that of said ionic surfactant and a nonionic surfactant, and wherein the colorant dispersion is comprised of a colorant in a surfynol nonionic water soluble surfactant; heating the formed sheared blend below about the glass transition temperature of the resin to form aggregates; and thereafter heating said aggregates above about the glass transition temperature of the resin.

37. A process in accordance with claim 36 wherein said surfynol surfactant is 2,4,7,9-tetramethyl-5 decyne-4,7-diol containing 2-butoxyethanol, 2,4,7,9-tetramethyl-5 decyne-4,7-diol containing ethylene glycol, and 2,4,7,9-tetramethyl-5 decyne-4,7-diol containing isopropyl alcohol.

38. A process in accordance with claim 1 wherein said surfynol surfactant is 2,4,7,9-tetramethyl-5 decyne-4,7-diol containing isopropyl alcohol, about 50 parts of the diol and about 50 parts of the isopropyl alcohol; 2,4,7,9-tetramethyl-5 decyne-4,7-diol containing 2-butoxyethanol, 2,4,7,9-tetramethyl-5 decyne-4,7-diol containing ethylene glycol, and 2,4,7,9-tetramethyl-5 decyne-4,7-diol containing isopropyl alcohol, about 10 to about 35 parts of 2,4,7,9-tetramethyl-5 decyne-4,7-diol, about 22 parts of 1,2 ethanediol, and from about 30 to about 60 parts of alkyarylalkoxylates.

* * * * *